US005700172A

United States Patent [19]

Ousley, II et al.

[11] Patent Number: 5,700,172

[45] Date of Patent: Dec. 23, 1997

[54] SUBMERGED MARINE EXHAUST SYSTEM

[75] Inventors: Frank Benson Ousley, II, Cocoa; Douglas Allen Keehn, Jr., Merritt Island, both of Fla.

[73] Assignee: Ray Industries, Inc., Knoxville, Tenn.

[21] Appl. No.: 629,212

[22] Filed: Apr. 8, 1996

Related U.S. Application Data

[63] Continuation-in-part of Ser. No. 374,228, Jan. 18, 1996, Pat. No. 5,505,644.

[51] Int. Cl.[6] ..... B63H 21/32

[52] U.S. Cl. ..... 440/88; 440/89

[58] Field of Search ..... 440/88, 89, 900, 440/113

[56] References Cited

U.S. PATENT DOCUMENTS

| | | | |
|---|---|---|---|
| 818,951 | 4/1906 | Goodwin | 440/89 |
| 1,824,738 | 9/1931 | Johnson et al. | 440/89 |
| 3,576,172 | 4/1971 | Ward | 440/89 |
| 5,022,877 | 6/1991 | Harbert | 440/89 |

*Primary Examiner*—Stephen Avila

*Attorney, Agent, or Firm*—Malin, Haley, DiMaggio & Crosby, P.A.

[57] ABSTRACT

An improved marine engine exhaust device for discharging exhaust below the surface of the water in a submerged turbulent region generated by said device which is fixed to a the undersurface of the vessel hull, wherein the gas is maintained for a period of time, until the low pressure area following the vessel has passed. The device incorporates a water intake for providing cooling water to the marine engine's cooling system and/or accommodates a sensing transducer mounted therein.

7 Claims, 4 Drawing Sheets

2/4

SUBMERGED MARINE EXHAUST SYSTEM

Continuation-in-Part of Ser. No. 08/374,228, filed Jan. 18, 1996, issued as U. S. Pat. No. 5,505,644 on Apr. 9, 1996.

BACKGROUND OF THE INVENTION

1. Field of the Invention

The present invention relates to marine exhaust systems and more particularly to a submerged marine exhaust fitting incorporating a cooling water intake and/or a transducer, for discharging marine engine exhaust below the surface of the water.

2. Description of the Prior Art

Marine exhaust systems found on motorized vessels typically discharge engine exhaust through discharge ports located above the water line towards the rear of the vessel or stern. Marine engine exhaust comprises a mixture of gas and cooling water. Conventional marine exhaust systems, typically known as water lift mufflers include: an internal combustion engine having at least one exhaust manifold for ducting engine exhaust to a muffler wherein exhaust gas sound is attenuated, and an exhaust pipe originating at the muffler and terminating at a discharge opening in the hull, located proximate the stern. Engine exhaust is discharged toward the rear of the vessel and above the water line where, in theory, the gases are dissipated or carried away from the vessel.

There are a number of inherent disadvantages present in the conventional prior art marine exhaust systems and methods. Firstly, Engine exhaust must first pass through a muffler so that excessive noise may be attenuated prior to discharge. Since marine exhaust includes a corrosive mixture of gas and water, marine mufflers must be rugged and are known to add substantial cost and weight to vessels. Secondly, when a vessel is at idle, engine exhaust gas tends accumulate around the vessel since the discharge ports are sized for higher exhaust flow rates, and low flow exhaust flow rates, like those experienced at idle or low speed, are not discharged with sufficient velocity to completely clear the area. Thus, engine exhaust discharged through hull openings may accumulate in proximity to the vessel thereby irritating those on board, unless carried away or dissipated by prevailing winds. Thirdly, most motorized vessels that incorporate conventional marine exhaust systems suffer from a problem resulting from the low pressure area formed behind a moving vessel, often referred to as the "station wagon effect". Typically, a low pressure area, caused by the vessel structure moving through the atmosphere, develops near the stern of a vessel. Engine exhaust discharged near the stern of a moving vessel therefore, is caught in the resulting low pressure area and recirculates into the passenger compartment thereby irritating those on board. Since engine exhaust includes carbon monoxide gas, a high exhaust gas concentration circulating within the passenger compartment is extremely undesirable.

The prior art reveals a number of attempts directed toward overcoming the aforementioned problems. For example, U.S. Pat. No. 5,234,364 issued to Ito, discloses an EXHAUST SYSTEM FOR SMALL PLANING BOAT. Ito teaches an exhaust system having an exhaust pipe which terminates in a flush discharge opening formed in a lower surface of the hull for discharging engine exhaust through the body of water in which the watercraft is operating. The system incorporates an expansion chamber for silencing engine exhaust, and a low speed exhaust discharge line extending from the highest portion of the exhaust pipe, through the hull, to an area above the water level so as to provide a low speed exhaust discharge for discharging exhaust when the watercraft is operating at idle or low speeds. Discharging engine exhaust through a flush hull opening below the surface, however, causes the exhaust to flow with the fluid boundary layer formed by the water on the moving hull and results in the exhaust surfacing immediately behind the craft where the exhaust is likely to recirculate within the passenger compartment because of the aforementioned station wagon effect.

U.S. Pat. No. 5,078,631 issued to Harbert, also discloses a MARINE EXHAUST SYSTEM. Harbert discloses a marine exhaust system for separating the gas from the water of a gas/water mixture produced by a marine engine and expelling the gas a sufficient distance from the hull of a boat to place it outside of the turbulent boundary layer surrounding the hull and the low pressure area following behind the boat. Harbert, however, relies on an intricate variable exhaust gas discharge outlet that reduces the outlet opening area at low flow rates for projecting exhaust gases a maximum distance from a boat hull, and does not contemplate discharging exhaust gases below the surface of the water.

U.S. Pat. No. 4,509,927, issued to Ikeda, discloses a BOTTOM EXHAUST HIGH SPEED BOAT having a hull including a grooved bottom. Ikeda teaches an engine exhaust pipe extending into a midportion of the grooved bottom, and a duct fixed to the surface of the hull extending between the opening of the exhaust pipe and the front of the grooved bottom for transporting exhaust gases to the front of the grooved bottom whereby the grooved bottom is filled with exhaust gases thereby decreasing frictional resistance.

This application is a Continuation-in-Part of Ser. No. 08/374,228, issued as U.S. Pat. No. 5,505,644 on Apr. 9, 1996, which overcomes the aforementioned problems with marine engine exhaust by disclosing a marine engine exhaust system for muffling a marine engine and discharging engine exhaust a sufficient distance from an idling vessel such that exhaust gas does not concentrate in proximity to the passenger compartment, and that discharges exhaust below the surface of the water, beyond the fluid boundary layer formed on the bottom of the hull while cruising, such that the discharged exhaust is further muffled and surfaces behind the low pressure area following the vessel thereby preventing recirculation within the passenger compartment. The disclosure of U.S. Pat. No. 5,505,644 is hereby incorporated herein by reference.

Motorized marine vessels also require engine cooling water to maintain normal engine operating temperatures. Typically, the body of water in which the vessel is operating provides the source for the water used to cool the engine. As a result, a dedicated water intake fitting, or water pick up, is commonly fastened to the bottom of the hull to provide a water intake for the engine's cooling system. However, mounting a submerged water pick up beneath the hull, reduces the hull's hydrodynamic efficiency by forming a drag inducing structure on the hull's otherwise streamlined surface thereby increasing drag and consuming engine horsepower. It is considered good design practice to install a shut off valve on the water pick up so that the valve may be shut off when the boat is left unattended in the water for an extended period of time. In case of leakage or broken water supply lines, the shut off valve may save the vessel from sinking at the dock.

Furthermore, other common hull mounted hardware, including electronic sensing means, such as sonar transducers, further degrade the hydrodynamic efficiency of the hull. Sonar transducers, variously referred to as "fish finders" or "depth sounders," have been available for some time. Transducers used to transmit and receive acoustical energy (SONAR) through the water can either be an integral part of the boat hull (the "through-the-hull" or "in-hull" design) or mounted by means of appropriate brackets to the lower part of the boat transom (the "transom-mount" design). Such "transom-mount" designs are most commonly used by sport fishermen.

Accordingly, there still exists a need for an improved submerged marine engine exhaust system which incorporates a cooling water intake in a single streamlined structure. Furthermore, there exists a need for an improved marine engine exhaust system which further incorporates a sonar transducer, thereby optimizing the hydrodynamic efficiency of the hull.

SUMMARY OF THE INVENTION

The present invention improves upon the invention disclosed in U.S. Pat. No 5,505,644 by incorporating a water intake in the submerged hydrodynamic exhaust fitting disclosed in the '644 Patent thereby eliminating the need for an additional drag inducing intake. In an alternate embodiment, the present invention contemplates a compartment for housing a sonar transducer.

Accordingly, the present invention contemplates an improved marine engine exhaust system for discharging exhaust, including a mixture of gas and water, above the water line when at idle or low speeds, and below the surface of the water at higher speeds in a turbulent region wherein the exhaust is maintained for a period of time, until the low pressure area following the vessel has passed, after which the exhaust surfaces and dissipates.

The hydrodynamic exhaust discharge means, or fitting, is mounted to hull bottom and includes: a mounting flange for fixing the hydrodynamic exhaust means to the bottom of the hull; a downwardly extending foil means defining an exhaust channel; and, a hydroconical exhaust discharge in fluid communication with said foil means. The hydrodynamic exhaust discharge means is shaped such that the downwardly extending foil creates less drag, and hence less turbulence in its wake, than the hydroconical exhaust discharge. As a result, when the vessel travels through the water discrete turbulence layers are formed below the hull undersurface by water passing around the hydrodynamic exhaust fitting.

Hydrodynamic forces operating on the fitting also cause the formation of an area of low pressure proximate the hydroconical exhaust discharge outlet, that, when combined with an increase in exhaust system pressure resulting from higher engine exhaust output, allow engine exhaust to exit the vessel below the surface of the water through the hydroconical exhaust discharge. Engine exhaust is thus discharged in a turbulent region formed by the hydroconical portions wake, and entrapped, thereby maintaining the exhaust below the surface for a period of time such that when the exhaust finally surfaces the vessel is a sufficient distance from the point of exhaust surfacing as not to induce exhaust gas recirculation within the passenger compartment.

The present invention incorporates the exhaust gas ducting accumulating means as disclosed in U.S. Pat. No. 5,505,064 and contemplates an improved hydrodynamic exhaust fitting as disclosed herein.

The improved hydrodynamic exhaust fitting retains the general external structural form of the fitting disclosed in the '064 Patent and further includes a downwardly extending foil having a leading portion defining an engine cooling water inlet and an internal water duct for directing cooling water to the vessel's engine. The downwardly extending foil leading portion defines a streamlined intake grill for allowing water to enter the engine's cooling system while preventing the entry of undesirable solid objects. In addition, a portion of the nose of the hydroconical exhaust portion of the fitting accommodates a transducer.

An alternate embodiment is disclosed wherein the hydroconical exhaust outlet is modified to allow greater exhaust flow rates, such as those produced by larger diesel engines. In the alternate embodiment, the hydroconical exhaust outlet is enlarged and modified by the addition of a lip extending normal to water flow streamlines. The extending lip further decreases the hydrostatic pressure at the exhaust outlet when the fitting is moving through the water by increasing the turbulence produced in the fitting's wake.

In accordance with the instant invention, it is an object thereof to provide an improved submerged marine engine exhaust fitting and cooling water intake, for discharging engine exhaust below the surface of the water and providing an intake for engine cooling water in a single unit.

A further object of the present invention is to provide an improved submerged marine engine exhaust fitting which an exhaust outlet, a cooling water intake, and a transducer mounted therein all in a single hydrodynamic fitting mounted beneath the hull.

In accordance with these and other objects which will become apparent hereinafter, the instant invention will now be described with particular reference to the accompanying drawings.

DESCRIPTION OF THE PREFERRED EMBODIMENTS

The disclosure of U.S. Pat. No. 5,505,644 is hereby incorporated herein by reference.

Figure 1:
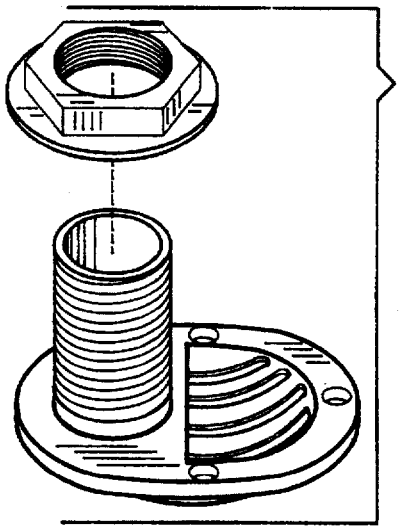
Fig. 1 (PRIOR ART)
FIG. 1 is an exploded perspective view of a through the hull prior art water inlet.

Turning first to FIG. 1, a prior art through the hull water inlet is depicted. Typically, such a prior art device is mounted in a submerged location in a through-the-hull configuration.

Turning now to FIGS. 2 and 4–6, there is disclosed an exploded view of an improved hydrodynamic exhaust means comprising a discharge fitting 10, for mounting to the bottom of a hull 11. The fitting 10 includes a mounting flange 12 defining a plurality of fastener apertures 14 for receiving stainless steel fasteners (not shown) therein. Fitting 10 defines an engine exhaust outlet and is in communication with a marine engine exhaust system.

Hydrodynamic exhaust discharge fitting 10 includes a downwardly extending streamlined foil section 16 terminating in a bullet-shaped hydroconical exhaust section 18 having a nose end 20 and an exhaust outlet 22. The hydrodynamic exhaust discharge fitting is structured such that the downwardly extending foil section 16 creates less drag than the bullet shaped discharge structure 18. As a result, when the vessel is moving, turbulent regions are formed below the hull by hydrodynamic fitting 10, and particularly by foil section 16 and bullet-shaped section 18. Since bullet-shaped section 18 is less streamlined than is foil section 16, the bullet-shaped section generates greater turbulence in its wake thereby creating a discrete, highly turbulent region separated from the bottom of the hull by a region of substantially less turbulence that is created by foil section 16.

Furthermore, the hydrodynamic forces operating on the fitting effectively lower the hydrostatic pressure at outlet 22, such that, exhaust gas exits the vessel below the surface of the water through the hydrodynamic fitting 10 via exhaust outlet 22 by overcoming the hydrostatic back pressure. The exhaust is thus discharged in the turbulent region formed by the hydroconical sections wake and entrapped, thereby maintaining the exhaust below the surface for a period of time such that when the exhaust finally surfaces the vessel is a sufficient distance from the point of exhaust surfacing as not to induce exhaust gas recirculation within the passenger compartment.

The improved hydrodynamic exhaust discharge fitting further includes a leading edge portion defining an engine cooling water inlet grill 24. A solid wall 26 cooperates with the remaining foil section structure to define a cooling water duct terminating in a pipe fitting 28, for connection to cooling system piping for placing intake grill 24 in fluid communication with the engine's cooling system. A valve 30 is preferably connected to pipe fitting 28 to protect the vessel from leaks in the cooling system during periods in which the vessel is left unattended in the water.

Accordingly, under normal operating conditions, engine exhaust gas exits the hydrodynamic fitting at exhaust outlet 22, while cooling water, for use in cooling the engine, enters fitting inlet grill 24, and is ducted to the engine's cooling system via fitting 28. Grill 24 functions to prevent intake of solid material and other unwanted debris. Solid wall 26 maintains separation of the cooling water and the flowing exhaust gas. As is now apparent, incorporating a water inlet for engine cooling water in the improved hydrodynamic exhaust fitting eliminates the need for additional, drag inducing, hull mounted hardware.

Figure 3:
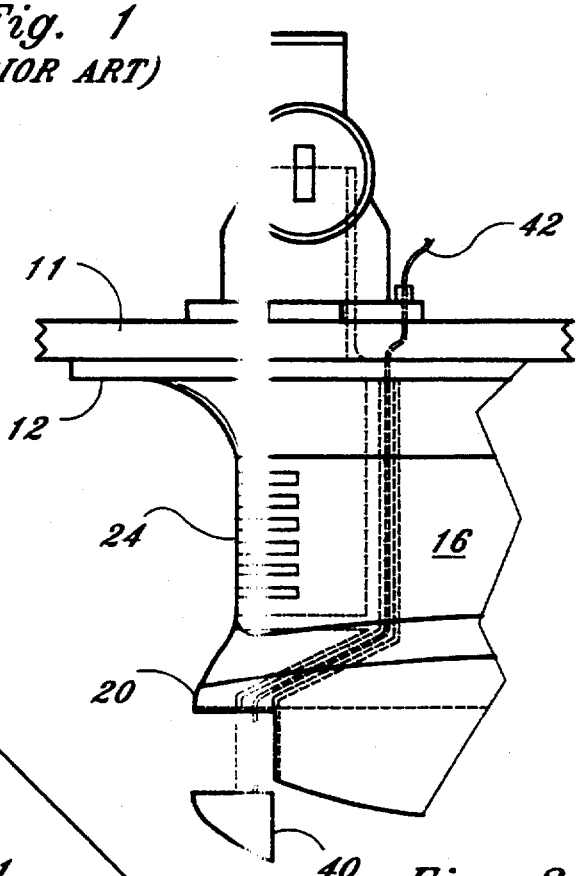
FIG. 3 is a partial view of the submerged exhaust fitting of the present invention incorporating a water inlet and a transducer.
Figure 2:
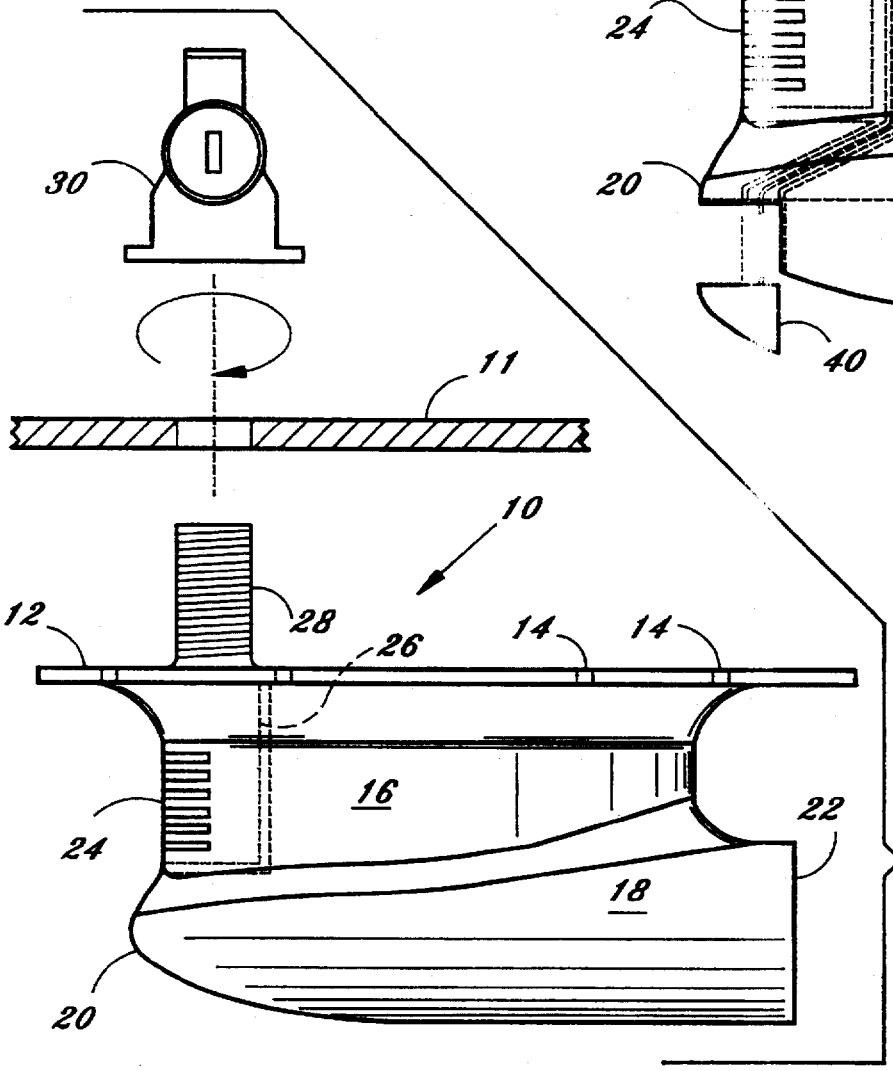
FIG. 2 is an exploded view of a hull and the submerged exhaust fitting of the present invention incorporating a water inlet.
Figure 4:
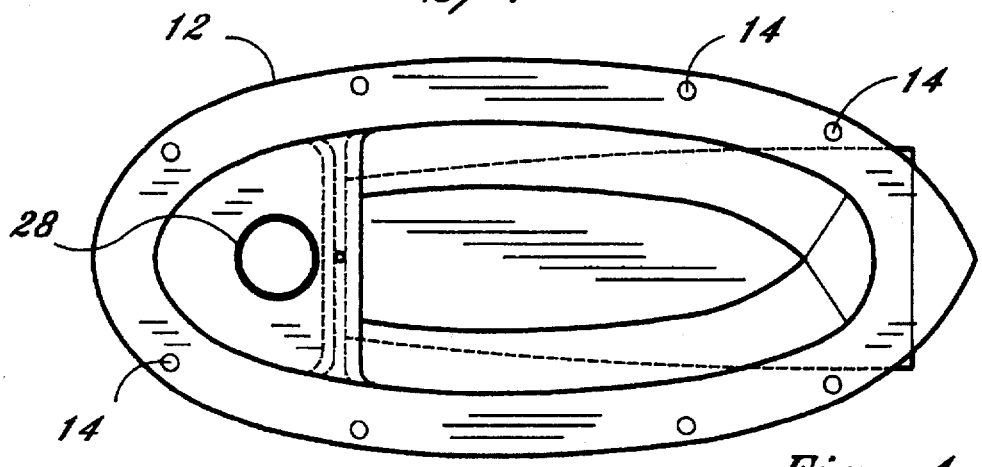
FIG. 4 is a top plan view of the submerged exhaust fitting of the present invention.
Figure 5:
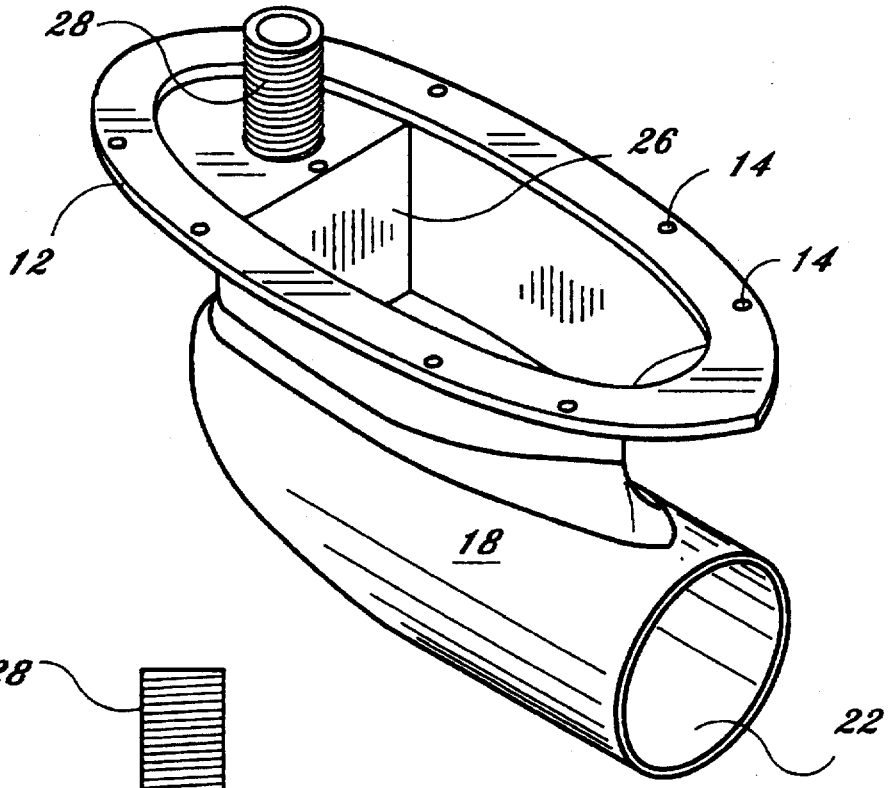
FIG. 5 is a perspective view of the submerged exhaust fitting of the present invention.
Figure 6:
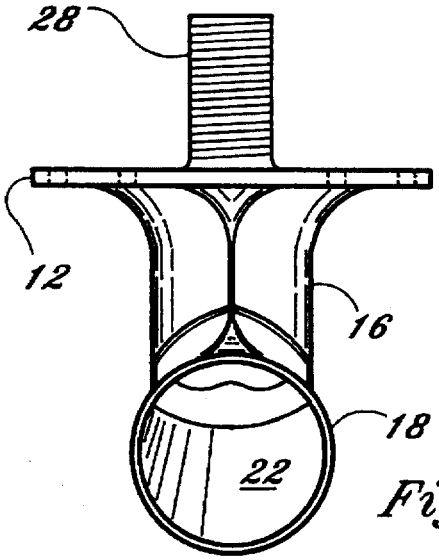
FIG. 6 is a rear elevational view of the submerged exhaust fitting of the present invention.

In an alternate embodiment, depicted in FIG. 3, the improved hydrodynamic exhaust fitting incorporates a hydroconical leading end 20 which houses a sonar transducer 40 or other suitable electronic sensing equipment (hereinafter "transducer"). In this embodiment, the nose end 20 of hydroconical exhaust section 18 defines a notch or other suitably shaped aperture for receiving a transducer 40 mounted therein. In the preferred embodiment, nose end 20 is notched and a contoured transducer 40 is mounted therein such that the overall streamlined shape of nose end 20 and hydroconical exhaust section 18 is maintained. A partition may cooperates with the remaining structure forming the hydroconical leading surfaces to form a compartment, thereby separating the transducer 40 housed therein from the exhaust gas and engine cooling water which simultaneously flow through the fitting. Transducer 40 electrically communicates with vessel mounted electronic equipment via electrical conductors 42. As is now apparent, housing electronic sensing equipment in the improved hydrodynamic exhaust fitting eliminates the need for additional, drag inducing, hull mounted hardware.

HIGH FLOW-RATE EMBODIMENT

Turning now to FIGS. 7 and 9–11, there is disclosed an alternate embodiment having an increased exhaust flow capacity and comprising a discharge fitting 110, for mounting to the bottom of a hull 111. The fitting 110 includes a mounting flange 112 defining a plurality of fastener apertures 114 for receiving stainless steel fasteners (not shown) therein for fastening fitting 110 to hull 111. Fitting 110 defines an engine exhaust outlet and is in communication with a marine engine exhaust system.

Figure 10:
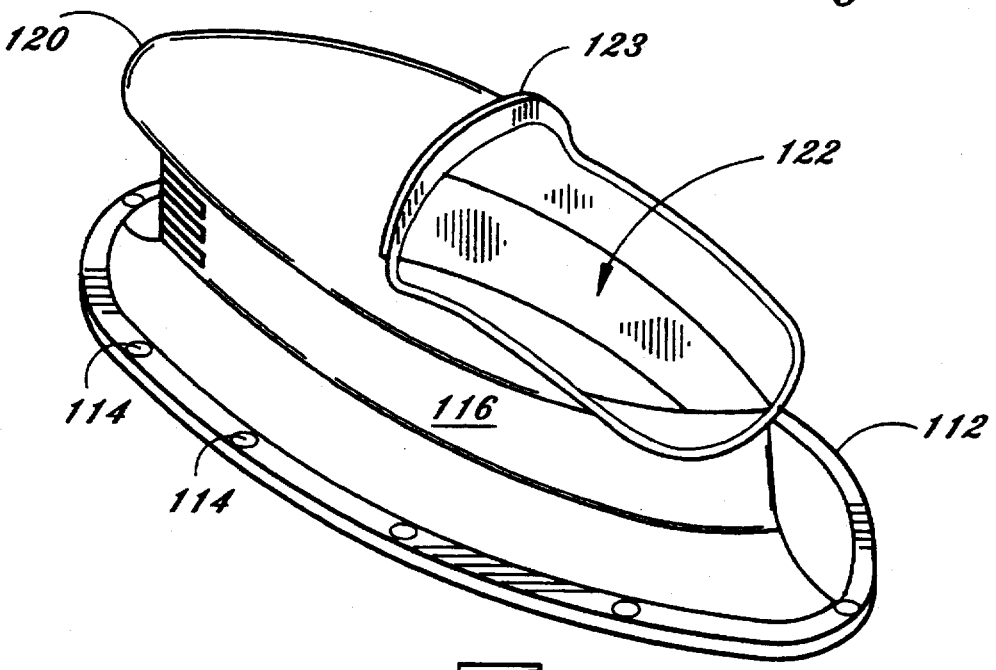
FIG. 10 is a bottom perspective view of an alternate embodiment of the submerged exhaust fitting of the present invention.
Figure 11:
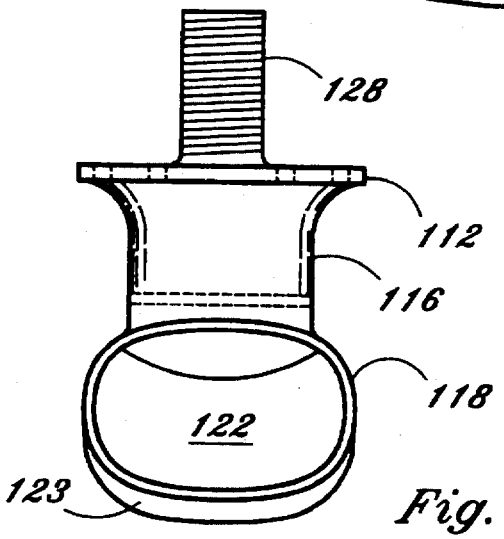
FIG. 11 is a rear elevational view of an alternate embodiment of the present invention.

Hydrodynamic exhaust discharge fitting 110 includes a downwardly extending streamlined foil section 116 terminating in a bullet-shaped hydroconical exhaust section 118 having a nose end 120 and an exhaust outlet 122. The hydrodynamic exhaust discharge fitting is structured such that the downwardly extending foil section 116 creates less drag than the bullet shaped discharge structure 118. As best depicted in FIG. 10, exhaust outlet 122 is enlarged relative to the embodiment shown in FIG. 5, to accommodate higher exhaust flow rates. In addition, the alternate embodiment exhaust outlet 122 includes a lip 123 extending normal to water flow streamlines. The extending lip 123 further decreases the hydrostatic pressure at the exhaust outlet when the fitting is moving through the water by increasing the turbulence produced in the fitting's wake.

When water flows around the fitting, turbulence generated in the fitting's wake effectively lowers the hydrostatic water pressure at outlet 122, such that, exhaust gas exits the vessel below the surface of the water through the hydrodynamic fitting 110 via exhaust outlet 122 by overcoming the hydrostatic back pressure. The exhaust is thus discharged in the turbulent region formed by the hydroconical sections wake and entrapped, thereby maintaining the exhaust below the surface for a period of time such that when the exhaust finally surfaces the vessel is a sufficient distance from the point of exhaust surfacing as not to induce exhaust gas recirculation within the passenger compartment.

The improved hydrodynamic exhaust discharge fitting may further include a leading edge portion defining an engine cooling water inlet grill 124. A solid wall 126 cooperates with the remaining foil section structure to define a cooling water duct terminating in a pipe fitting 128, for connection to cooling system piping for placing intake grill 124 in fluid communication with the engine's cooling system. A valve 130 is preferably connected to pipe fitting 128 to protect the vessel from leaks in the cooling system during periods in which the vessel is left unattended in the water. As is now apparent, incorporating a water inlet for engine cooling water in the improved hydrodynamic exhaust fitting eliminates the need for additional, drag inducing, hull mounted hardware.

Figure 8A:
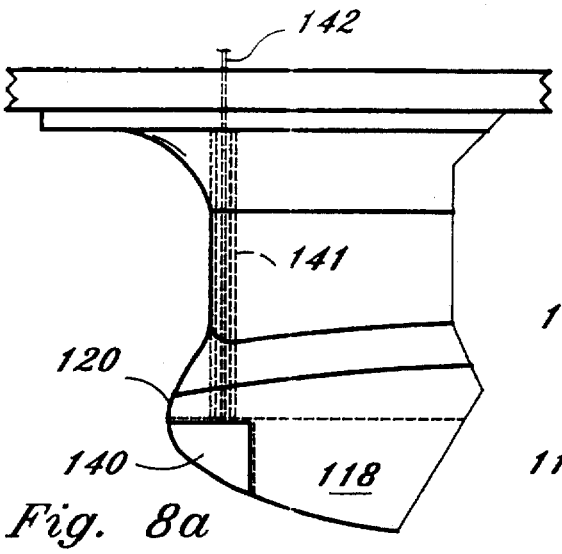
FIG. 8*a* is a partial view of an alternate embodiment of the submerged exhaust fitting of the present invention incorporating a transducer.
Figure 8B:
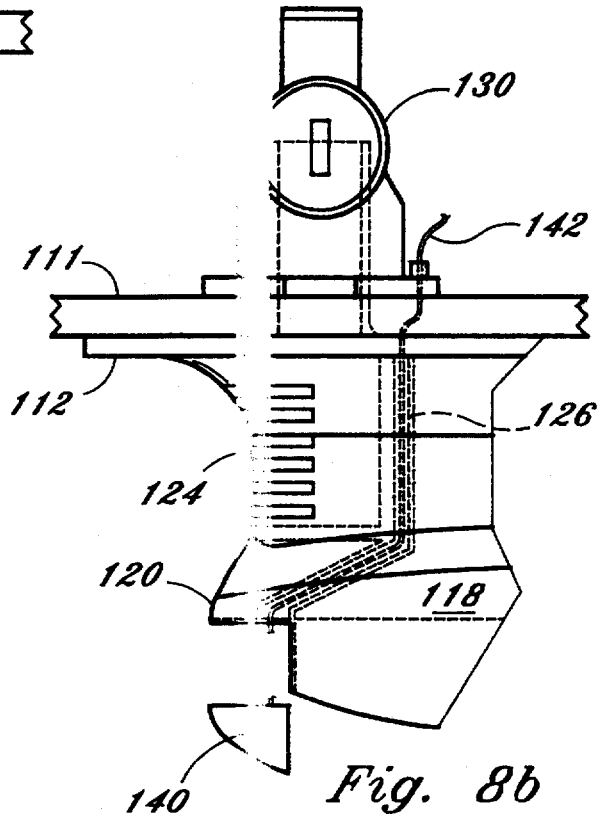
FIG. 8*b* is a partial view of an alternate embodiment of the submerged exhaust fitting of the present invention incorporating a water inlet and a transducer.
Figure 7:
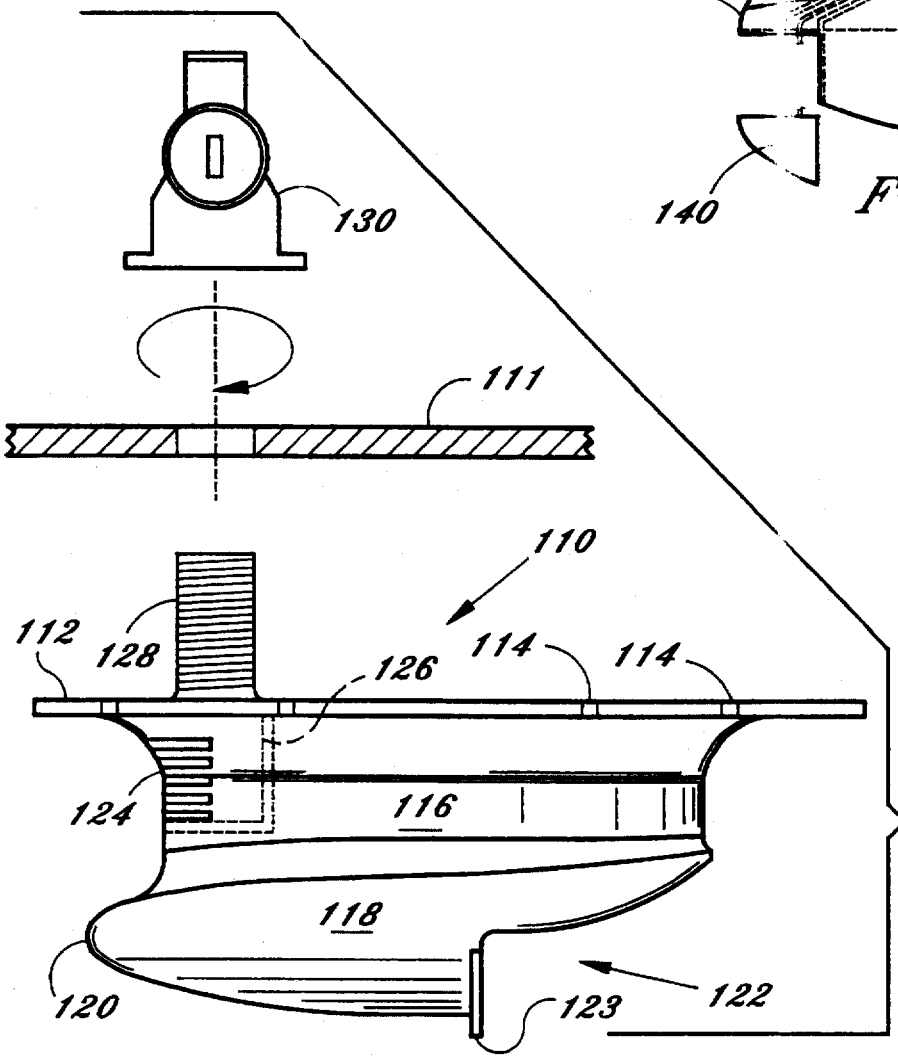
FIG. 7 is an exploded view of a hull and an alternate embodiment of the submerged exhaust fitting of the present invention incorporating a water inlet.
Figure 9:
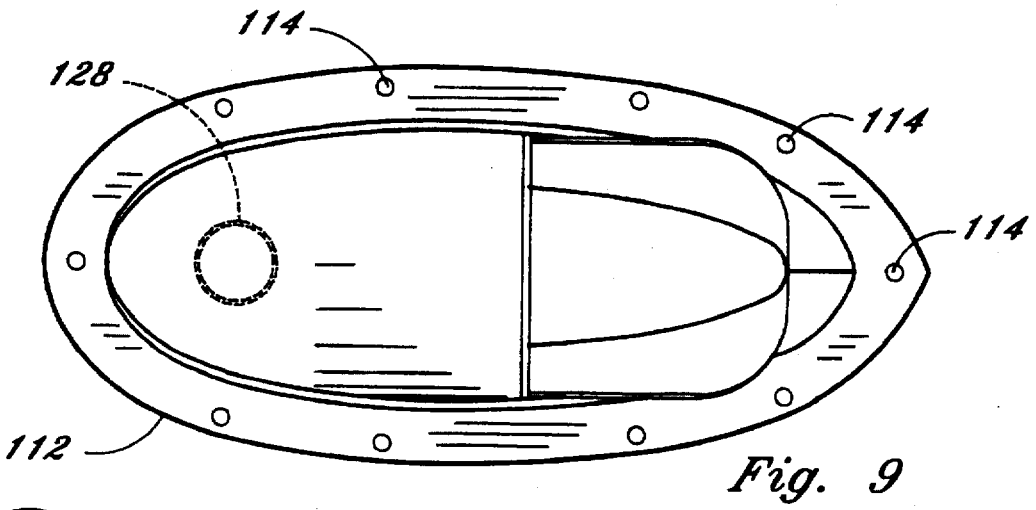
FIG. 9 is a bottom plan view of an alternate embodiment of the submerged exhaust fitting of the present invention.

In an alternate embodiment, depicted in FIG. 8*a*, the improved hydrodynamic exhaust fitting incorporates a hydroconical leading end 120 which houses a transducer 140. Transducer wires 142 may be shielded by walls 141, or in the alternative, a conduit (not shown) may be formed in the hydrodynamic exhaust fitting walls during fabrication. In the embodiment depicted in FIG. 8*b* the hydrodynamic exhaust fitting incorporates a transducer 140 and an engine water inlet 124. The nose end 120 of hydroconical exhaust section 118 defines a notch or other suitably shaped aperture for receiving a transducer 140 mounted therein. In the preferred embodiment, nose end 120 is notched and a contoured transducer 140 is mounted therein such that the overall streamlined shape of nose end 120 and hydroconical exhaust section 118 is maintained. A partition may cooperate with the remaining structure forming the hydroconical nose surfaces to form a compartment, thereby separating the transducer 140 housed therein from the exhaust gas and engine cooling water which simultaneously flow through the fitting. As is now apparent, housing electronic sensing equipment in the improved hydrodynamic exhaust fitting eliminates the need for additional, drag inducing, hull mounted hardware.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. A submerged exhaust device for use with a marine engine mounted in a vessel, said vessel having a hull with an undersurface that is submerged when said vessel is placed within a body of water, said exhaust device comprising:

a submerged hydrodynamic exhaust outlet means fixed to said hull undersurface;

said hydrodynamic exhaust outlet means defining an exhaust chamber and including a downwardly extending streamlined first section having a low coefficient of drag for minimizing turbulent wake, said first section terminating in a second section having a higher coefficient of drag for generating a submerged layer of turbulent wake separated from the bottom of the hull by a region of substantially less turbulence created by said first section, said second section incorporating a submerged exhaust outlet, for discharging exhaust in said submerged turbulent layer such that said exhaust remains submerged until said vessel has cleared the vicinity;

said submerged hydrodynamic exhaust outlet means defining at least one auxiliary internal chamber.

2. A submerged exhaust device for use with a marine engine according to claim 1, wherein said auxiliary chamber comprises a water inlet communicating with said marine engine for supplying cooling water thereto.

3. A submerged exhaust device for use with a marine engine according to claim 1, wherein said auxiliary chamber houses a transducer.

4. A submerged exhaust device for use with a marine engine according to claim 1, wherein said submerged exhaust outlet includes a peripheral lip for generating turbulence proximate said exhaust outlet.

5. A submerged exhaust device for use with a marine engine mounted in a vessel, said marine engine having an exhaust system, said vessel having a hull with an undersurface that is submerged when said vessel is placed in a body of water, said exhaust device comprising:

a hydrodynamic fitting communicating with said engine exhaust system, said hydrodynamic fitting fixed to said hull and including a downwardly extending streamlined first section terminating with a turbulent wake generating second section, said second section defining a submerged exhaust outlet for discharging engine exhaust in a submerged turbulent layer whereby discharged exhaust remains submerged until said vessel has cleared the vicinity;

said hydrodynamic fitting including a water inlet communicating with said marine engine for supplying cooling water thereto.

6. A submerged exhaust device for use with a marine engine according to claim 5, further comprising means for mounting a means for sensing.

7. A submerged exhaust device for use with a marine engine mounted in a vessel, said vessel having a hull with an undersurface that is submerged when said vessel is placed within a body of water, said exhaust device comprising:

a hydrodynamic fitting fixed to said hull undersurface and including a downwardly extending streamlined section having a low coefficient of drag for minimizing turbulent wake terminating in a second section having a high coefficient of drag for generating a submerged layer of turbulent wake, said second hydrodynamic fitting section incorporating a submerged exhaust outlet, for discharging exhaust in said submerged turbulent layer such that said exhaust remains submerged until said vessel has cleared the vicinity;

said hydrodynamic fitting further including cooling water intake in communication with said marine engine; and a transducer housed within said fitting.

* * * * *